US007722007B2

(12) United States Patent
Stengel

(10) Patent No.: US 7,722,007 B2
(45) Date of Patent: May 25, 2010

(54) FLIP CHART EASEL WITH IMPROVED PIVOTAL STRUT MECHANISM

(75) Inventor: Michael John Stengel, Town and City, MO (US)

(73) Assignee: Swank Audio Visuals, LLC, St. Louis, MO (US)

( * ) Notice: Subject to any disclaimer, the term of this patent is extended or adjusted under 35 U.S.C. 154(b) by 0 days.

(21) Appl. No.: 12/123,968

(22) Filed: May 20, 2008

(65) Prior Publication Data

US 2009/0289167 A1 Nov. 26, 2009

(51) Int. Cl.
*F16M 11/38* (2006.01)

(52) U.S. Cl. ..... 248/435; 248/460; 248/461; 248/462; 248/463; 248/464; 248/465; 248/459; 248/688; 248/177.1; 248/176.1; 248/188; 248/188.1; 248/188.7; 248/188.8; 248/188.91; 248/188.5; 248/188.6; 248/434; 248/453; 248/452; 248/441.1

(58) Field of Classification Search ..... 248/460, 248/461, 462, 463, 464, 465, 459, 688, 177.1, 248/176.1, 188, 188.1, 188.7, 188.8, 188.91, 248/188.6, 188.5, 435, 434, 453, 452, 441.1
See application file for complete search history.

(56) References Cited

U.S. PATENT DOCUMENTS 384,171 A * 6/1888 Morris ..... 248/463
2,047,075 A * 7/1936 Kremen ..... 248/465
2,662,680 A * 12/1953 Bronson ..... 182/166
4,017,049 A * 4/1977 Albee, Jr. ..... 248/464
4,326,687 A * 4/1982 Clyburn ..... 248/168
4,643,384 A * 2/1987 Guerin ..... 248/476
4,826,125 A * 5/1989 Kelley ..... 248/463
5,125,613 A * 6/1992 Albee et al. ..... 248/464
7,213,794 B1 * 5/2007 Jefferies ..... 248/460

* cited by examiner

*Primary Examiner*—J. Allen Shriver, II
*Assistant Examiner*—Nkeisha J Smith
(74) *Attorney, Agent, or Firm*—Howard B. Rockman

(57) ABSTRACT

A foldable easel strut assembly is provided for supporting the easel when the easel is in use, and for moving the legs of the easel to a storage position when the easel is to be stored. The invention comprises an easel support board to which a rear leg assembly is pivotally connected. A pair of forward struts are pivotally connected at a first end to the support board. A pair of rear struts each have a first end pivotally connected to a second end of a corresponding forward strut, and a second end of each rear strut is pivotally connected to the rear leg assembly. Each rear strut includes a stop flange that abuts an upper edge of a corresponding forward strut when the rear leg assembly is pivoted away from the support board to a maximum position. In an embodiment, two front legs are pivotally connected to the support board, and the rear leg assembly comprises a rear leg member that pivotally folds against a bracket, and the bracket folds against the support board, when the easel is in its storage position.

12 Claims, 3 Drawing Sheets

FLIP CHART EASEL WITH IMPROVED PIVOTAL STRUT MECHANISM

This patent application relates to a flip chart easel, and in particular to a foldable easel strut assembly providing pivotal movement between a flip chart support structure and a pivotal rear leg.

Flip chart easels for use as an aid in making oral or visual presentations usually comprise a support board for holding large display charts, for example, where the board is supported on three or four legs. Two front legs usually extend downward from the support for the display chart, and in some embodiments, the front legs are pivotally attached to the support to allow the front legs to be folded against the support for storage.

In some flip chart easel configurations, a rear leg is pivotally attached to a rear portion of the support board, usually at the top. The rear leg is adapted to pivot rearwardly outward from its pivot point on the support board to form a tripod structure in combination with the front legs to maintain the easel in its upright and operative position. For storage purposes, the rear leg pivots to a position against the support board, and in certain embodiments the rear leg comprises two pivotally connected leg portions that also allow the rear leg to be folded on itself for storage purposes.

In certain of the tripod embodiments described above, a pivotal strut system extends between the rear of the support board of the easel and the rear leg. The strut system limits the outward movement of the rear leg, and maintains the rear leg in its necessary outward position to form the tripod configuration with the two front legs. It is important that the strut system provide ease of movement of the rear leg from a folded storage position to an extended position forming the tripod structure. It is also important that the strut system automatically limit outward movement of the rear leg when the tripod position is reached. Further, it is important that the strut system be lightweight and inexpensive to manufacture and easy to assemble and operate.

SUMMARY OF THE INVENTION

The present invention comprises a strut assembly for the legs of a foldable tripod strut support system for a flip chart easel, or other easels. The strut assembly includes a pair of forward struts pivotally attached to a support board of the easel at one end, and pivotally attached at the other end to one end of a pair of rear struts. The opposite ends of the rear struts are pivotally attached to the rear leg of the assembly. The top end of the rear leg is pivotally attached to the easel support board.

A portion of the rear struts extend beyond the pivotal connection between the respective front and rear struts. Each of these extensions include a stop flange that extends laterally over an upper edge of the respective forward strut just beyond the pivotal connection. When the rear leg is pivotally moved to its extended or operative position, the forward struts and rear struts move from a folded or storage position to an approximate straight line position when the rear leg is fully extended. In this approximate straight line position, the stop flange on each rear strut engages an upper surface of a respective forward strut, thus preventing further pivotal movement of the strut assembly and maintaining the rear leg in its proper outward position.

For added lateral support, a cross beam extends between the two pivotal junctions connecting each front strut to a respective rear strut.

BRIEF DESCRIPTION OF THE DRAWINGS

Certain examples of the present invention are illustrated by the accompanying figures. It should be understood that the figures are not necessarily to scale and that details that are not necessary for an understanding of the invention, or that render other details difficult to perceive, may be omitted. It should be understood, of course, that the invention is not necessarily limited to the particular examples illustrated herein.

DETAILED DESCRIPTION OF THE ILLUSTRATED EMBODIMENT

Figure 1:
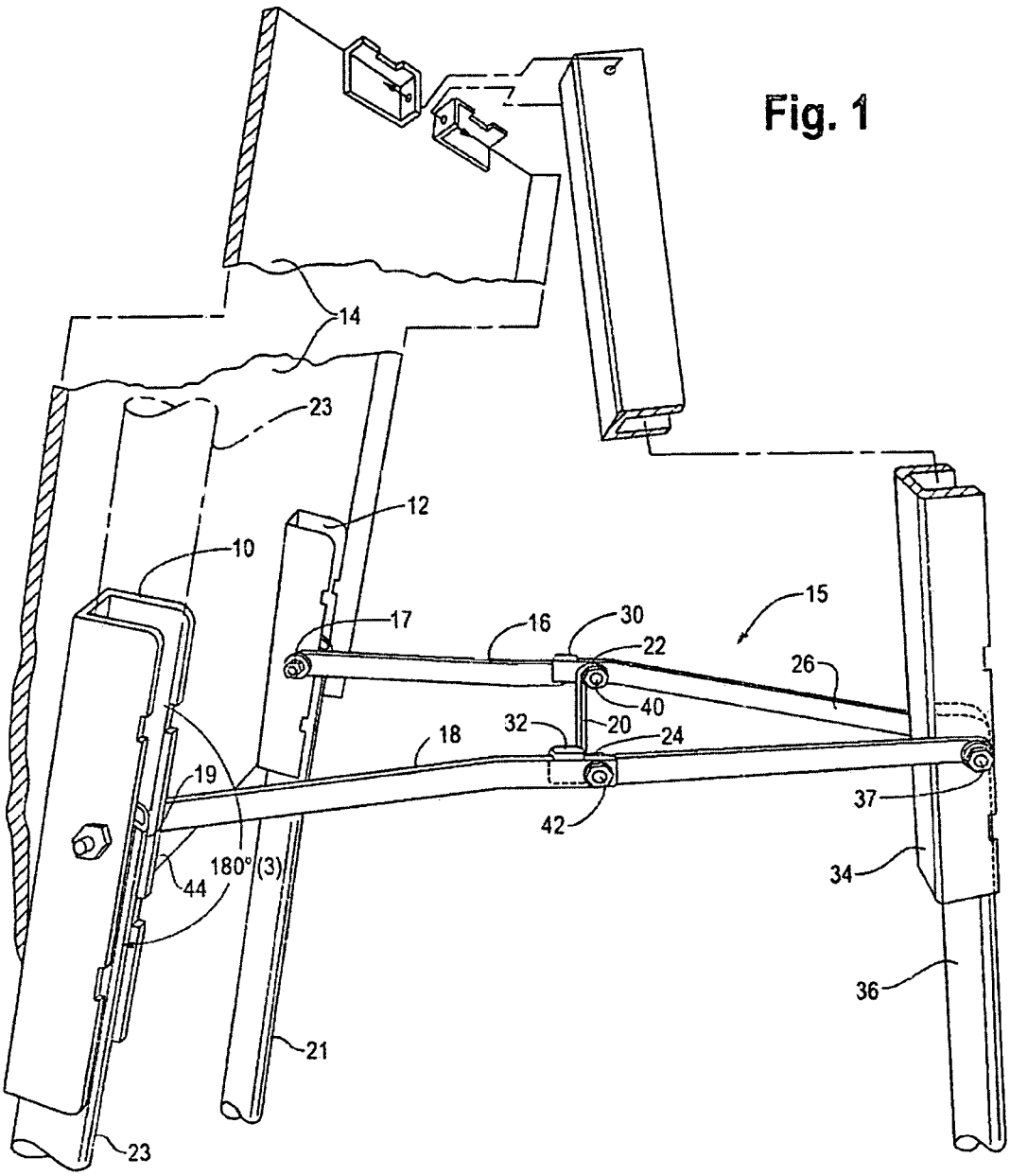
FIG. 1 is a perspective side elevation view of the pivotal strut assembly for a flip chart easel of the present invention, shown in the extended position.

Referring to FIG. 1, U-shaped brackets 10, 12 are attached to the rear of easel display or support board 14. Forward struts 16, 18 of strut assembly 15 are pivotally connected to the outer side walls of brackets 10 and 12 at a first end of each forward strut, as shown at pivot points 17 and 19. Forward legs 21, 23 are also pivotally connected to respective brackets 10, 12 at pivot points 17, 19 respectively, and are adapted to extend downward from between the side walls forming brackets 10, 12 when in the supporting or extended position. For storage, forward legs 21, 23 are pivoted around pivot points 17, 19 to an upward position extending between the sidewalls of the respective channels.

Cross beam 20 is pivotally connected to an opposite end of each forward strut 16, 18. Flanges 22, 24 are disposed on and extend ninety degrees from either end of cross beam 20. Rear struts 26, 28 are pivotally attached at pivot points 40, 42 to forward struts 16, 18, respectively, and to cross beam 20. The opposite ends of rear struts 26, 28 are pivotally attached to a U-shaped bracket 34. Bracket 34 is pivotally attached to rear leg 36 at pivot point 37, wherein bracket 34 and rear leg 36 form a rear leg assembly. Rear leg 36 is also pivotally attached at 35 (FIG. 3) to the top of the flip chart easel support board 14.

Figure 2:
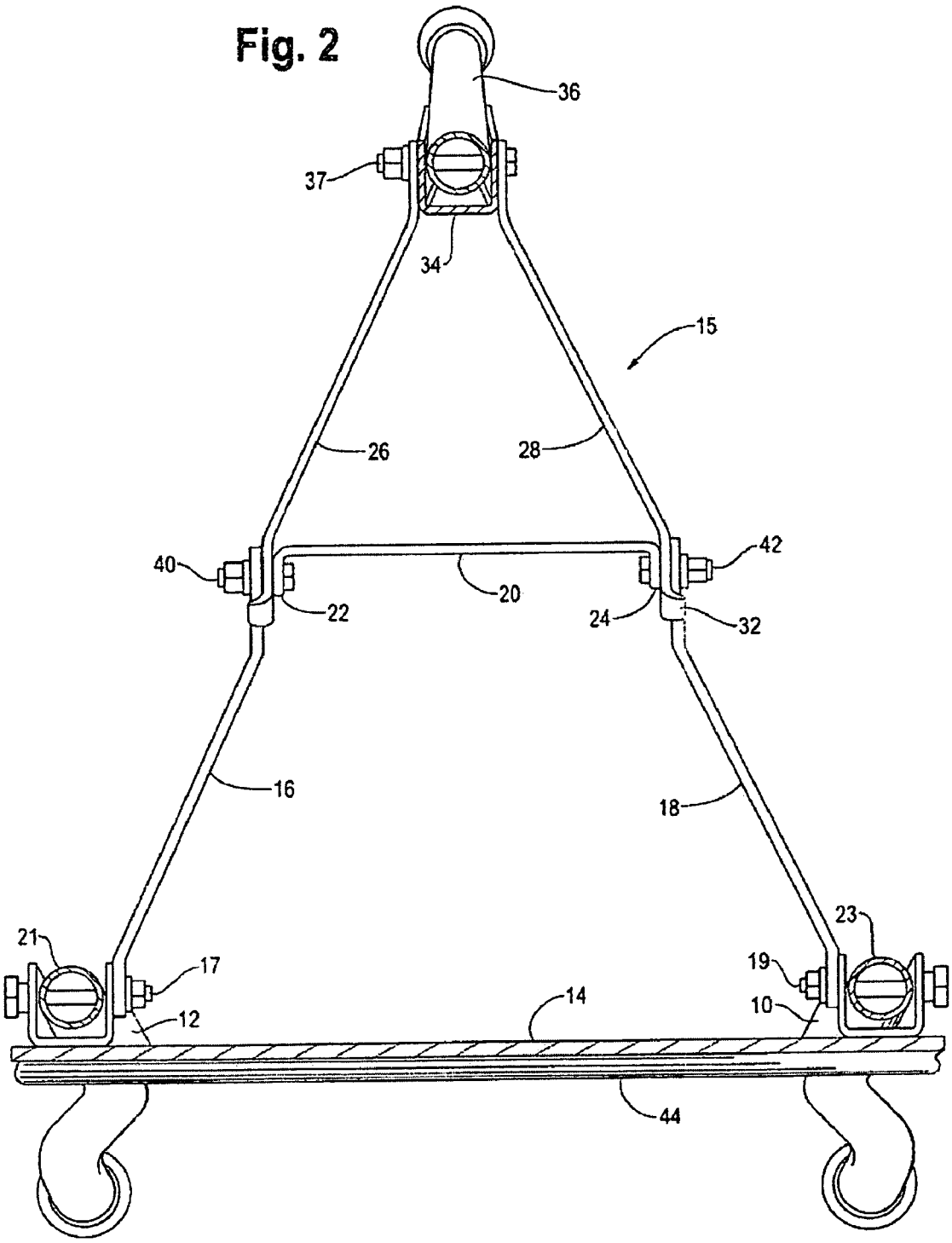
FIG. 2 is a top plan-view of the pivotal strut assembly of FIG. 1.
Figure 3:
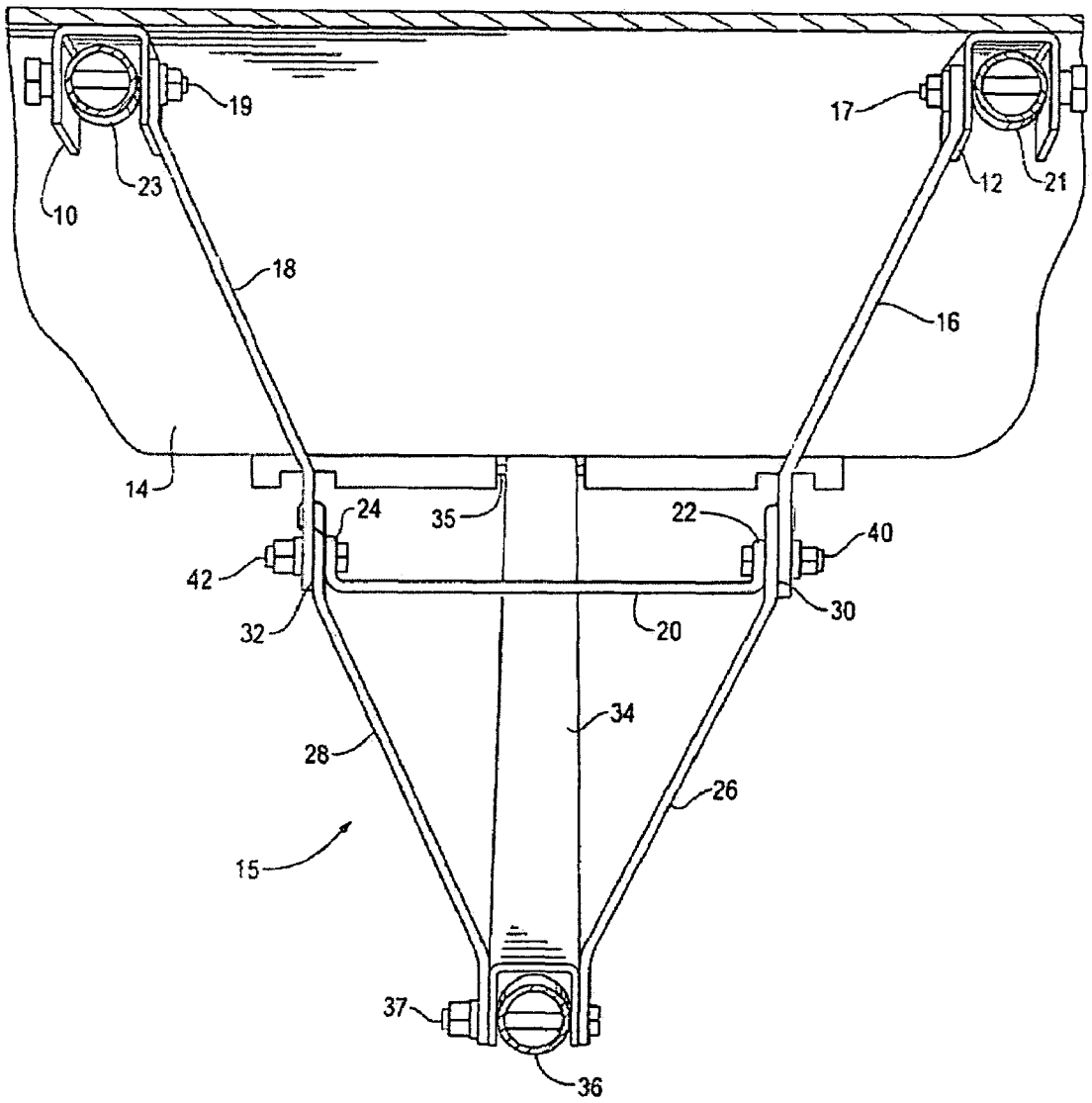
FIG. 3 is a bottom plan view of the pivotal strut assembly of FIG. 1.

As seen in FIGS. 1, 2 and 3, portions of rear struts 26, 28 extend beyond pivot points 40, 42. Stop flanges 30, 32 are mounted at right angles to the extensions of rear struts 26, 28. Stop flanges 30, 32 engage the side surfaces of front struts 16, 18 when the easel is fully open, and the stop flanges prevent further over center movement of strut assembly 15 with the legs 21, 23 and 36 in the position shown in FIGS. 1-3, when the front and rear struts are in a substantially straight line configuration. In this configuration, rear leg 36 is in its full outward position, and is held in that position by rear struts 26, 28 and forward struts 16, 18.

Upon use of the easel 14, rear leg 36 is manually pivoted outward from the top of easel 14. Struts 16, 18, 26 and 28 pivot until they are in a substantially straight line parallel to the floor, and stop flanges 30, 32 engage an edge portion of respective front struts 16, 18. Further pivotal movement of all of the struts relative to cross beam 20 is thus prevented, and rear leg 36 is held in its outermost pivotal position.

To fold easel 14 into its storage position, the first step is to manually apply an upward force to cross beam 20, causing struts 16, 18, 26 and 28 to pivot at points 40, 42, whereby stop flanges 30, 32 become disengaged with their respective edge portions of forward struts 16, 18. Bracket 34 pivots at point 35 toward easel 14 as cross beam 20 is moved upward. At the same time, rear struts 26, 28 move towards a parallel relationship with forward struts 16, 18. Also, leg 36 pivots towards a position in the plane of the rear of support board 14 as the strut pairs are moved together. The upward force is continually applied to cross beam 20 until bracket 34 is lodged against easel 14 in its storage position, and forward struts 16 and 18 are substantially parallel to rear struts 26, 28.

The length of struts 16, 18 is substantially equal to the length of struts 26 and 28, insuring that when bracket 34 is in its maximum folded position against support board 14, bracket 34 is closely adjacent to support board 14 and struts 16, 18, 26 and 28 are in their maximum folded position. Also, the ends of the struts 16, 18, 26 and 28 are angled to meet in parallel planes with cross beam 20 at pivot points 40, 42, to enable pivoting of the struts and cross beam with minimum friction.

After rear bracket 34 is in position against support board 14, leg 36 is pivoted one hundred eighty degrees around pivot point 37, until rear leg 36 is lodged in the channel formed by the side walls of U-shaped bracket 34. In the illustrated embodiment, the lower extent of bracket 34 is approximately at the lower edge 44 of support board 14 when bracket 34 is positioned against support board 14 in the storage position.

The next step is to pivot front leg 21 about pivot point 17 over a one hundred eighty degree arc until front leg 21 lies adjacent support board 14. In similar fashion, front leg 23 is pivoted about pivot point 19 through a one hundred eighty degree arc until front leg 23 is also positioned adjacent support board 14. With rear leg 36 and both front legs 21, 23 positioned adjacent support board 14, a snap-button strap, or other suitable tying device, may be extended around legs 21, 23 and 36, and around support board 14 to releasably hold the legs in their storage position.

The present invention has been described as an embodiment for providing a pivotal, limited movement easy to operate strut assembly for maintaining the rear leg of an easel in a tripod configuration in combination with the front legs of the easel. In addition the present invention provides a strut assembly and pivotal leg combination that allows the front and rear legs of the easel to be individually folded into a storage position when the strut assembly pivots the bracket holding the rear leg to a storage position. It is to be understood that the disclosed strut assembly invention can also be used in support structures other than easels. It is intended that the scope of this invention not be limited by the specification, but be defined by the claims set forth below.

I claim:

1. A foldable easel strut assembly for supporting the easel, comprising:

a support board;

a rear leg assembly pivotally fastened to a portion of said support board:

said rear leg assembly comprising a U-shaped bracket pivotally fastened at one end to said portion of said support board, and a rear leg member pivotally connected to a second end of said U-shaped bracket;

said rear leg member seated in said U-shaped bracket when said rear leg member is pivoted to a folded position against said support board;

a pair of forward struts pivotally connected at a first end to said support board;

a pair of rear struts each having a first end pivotally connected to a second end of a corresponding forward strut, a second end of each rear strut pivotally connected to said U-shaped bracket of said rear leg assembly.

2. The foldable easel strut assembly of claim 1, further including a cross beam extending from the pivotal connection of one said forward strut with one said rear strut to the pivotal connection of the other forward strut with the other rear strut.

3. The foldable easel strut assembly of claim 2 wherein upward movement of said cross beam applies a force to said rear leg to pivotally move said rear leg assembly toward said support board.

4. The foldable easel strut assembly of claim 1, further including a pair of U-shaped brackets fastened to a second portion of said support board;

first and second forward legs each pivotally connected to corresponding one of said U-shaped brackets.

5. A foldable easel comprising:

first and second forward legs pivotally connected to a support board;

a rear leg assembly pivotally connected to a portion of said support board;

first and second U-shaped brackets attached to said support board;

each of said first and second forward legs pivotally connected to one of said first and second brackets;

a foldable strut assembly pivotally connected between said support board and said rear leg assembly, said foldable strut assembly moveable from a first folded position to a second extended position, said foldable strut assembly including stop flanges limiting movement of said foldable strut assembly when said foldable strut assembly is in said second extended position;

said foldable strut assembly including a pair of forward struts each pivotally connected to a corresponding one of said U-shaped brackets, and a pair of rear struts pivotally connected to said rear leg assembly.

6. The foldable easel of claim 5 including:

a cross beam extending between the pivotal connection of each forward strut with a corresponding rear strut.

7. The foldable easel of claim 5 further comprising:

said rear leg assembly including a third U-shaped bracket pivotally connected to said support board, a rear leg member pivotally connected to said third bracket.

8. The foldable easel of claim 7, wherein:

said first forward leg and said second forward leg are pivoted adjacent said support board when said foldable easel is in said first folded position; and said rear leg member is pivoted adjacent said third bracket, and said third bracket is pivoted adjacent said support board when said foldable easel is in said first folded position.

9. The foldable strut assembly of claim 1, wherein:

said second ends of each rear strut are pivotally attached to said U-shaped bracket of said rear leg assembly.

10. The foldable strut assembly of claim 9, wherein:

said second ends of each rear strut and said rear leg member are attached to said U-shaped bracket at a common pivot point.

11. The foldable easel strut assembly of claim 4, wherein:

each of said pair of forward struts is pivotally attached at one end to a corresponding U-shaped bracket that is attached to said second portion of said support board.

12. The foldable easel strut assembly of claim 11, wherein:

each of said first and second forward legs and each said one end of said forward struts are pivotally attached to a corresponding U-shaped bracket at a common pivot point.

* * * * *